United States Patent [19]

Yim

[11] 4,293,280

[45] Oct. 6, 1981

[54] TRANSCAVITATING PROPELLER

[75] Inventor: Bohyun Yim, Rockville, Md.

[73] Assignee: The United States of America as represented by the Secretary of the Navy, Washington, D.C.

[21] Appl. No.: 181,583

[22] Filed: Aug. 27, 1980

[51] Int. Cl.[3] ..... B63H 1/18

[52] U.S. Cl. ..... 416/237; 416/175; 416/236 A

[58] Field of Search ..... 416/237, 236 A, 175 R

[56] References Cited

U.S. PATENT DOCUMENTS

| | | | |
|---|---|---|---|
| D. 138,866 | 9/1944 | Orsett | 416/237 X |
| 329,822 | 11/1885 | De Bruignac | 416/237 |
| 1,688,639 | 10/1928 | Larson | 416/237 X |
| 1,872,749 | 8/1932 | Karageorge | 416/237 |
| 2,327,453 | 8/1943 | Presser | 416/175 X |
| 2,421,798 | 6/1947 | Marshall | 416/237 |
| 3,065,723 | 11/1962 | Tulin | 416/237 X |
| 3,077,173 | 2/1963 | Lang | 416/237 X |
| 3,306,246 | 2/1967 | Reder | 416/237 X |
| 3,572,962 | 3/1971 | Embleton et al. | 416/237 X |

FOREIGN PATENT DOCUMENTS

| | | | |
|---|---|---|---|
| 21828 | 4/1948 | Finland | 416/237 |
| 2314862 | 1/1977 | France | 416/237 |

*Primary Examiner*—Everette A. Powell, Jr.

*Attorney, Agent, or Firm*—R. F. Beers; L. A. Marsh; W. W. Randolph

[57] ABSTRACT

A propeller blade for a multi-bladed propeller comprises a radial inner portion, a radially outer portion and a transition portion extending therebetween. Generally, the leading edge of the blade portions are colinear and the trailing edges of the inner and outer blade portions are offset from each other so that shoulders are defined on the transition portion and the outer blade portion has a higher blade angle of attack than the inner blade portion. The shoulders extend from the leading edge to the trailing edge of the transition for providing flow stability and blade reinforcement.

13 Claims, 6 Drawing Figures

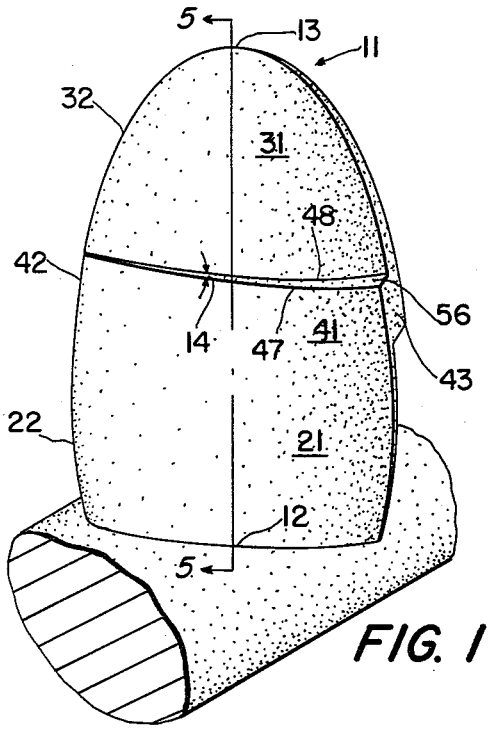
FIG. 1
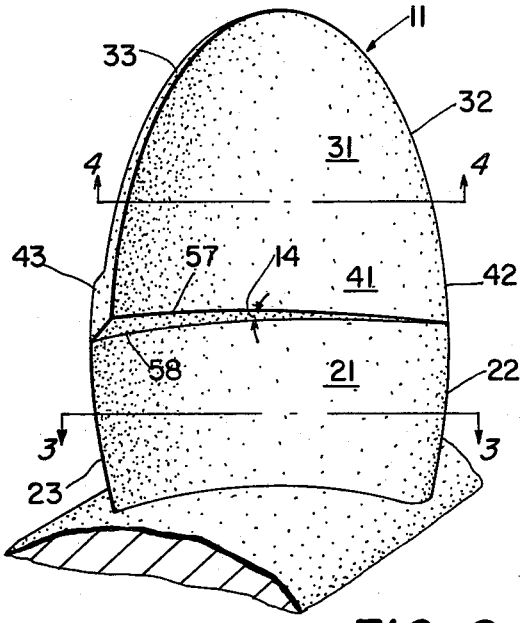
FIG. 2
FIG. 3
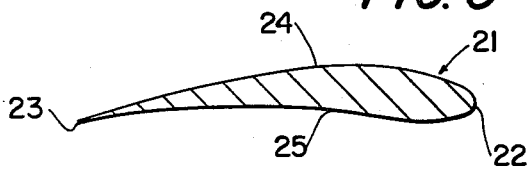
FIG. 4
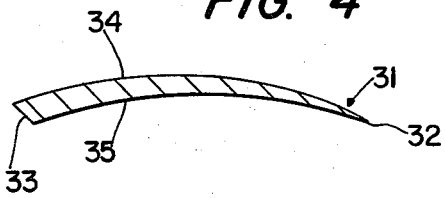
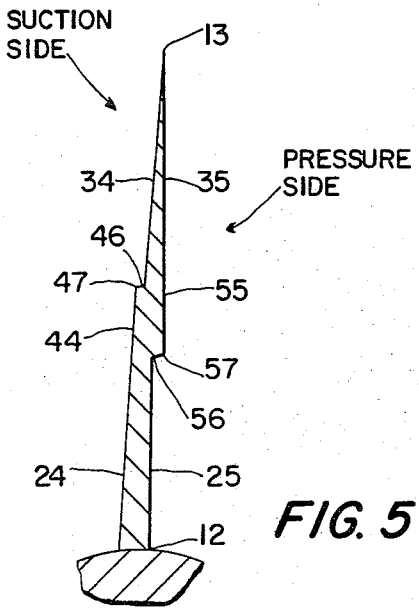
FIG. 5
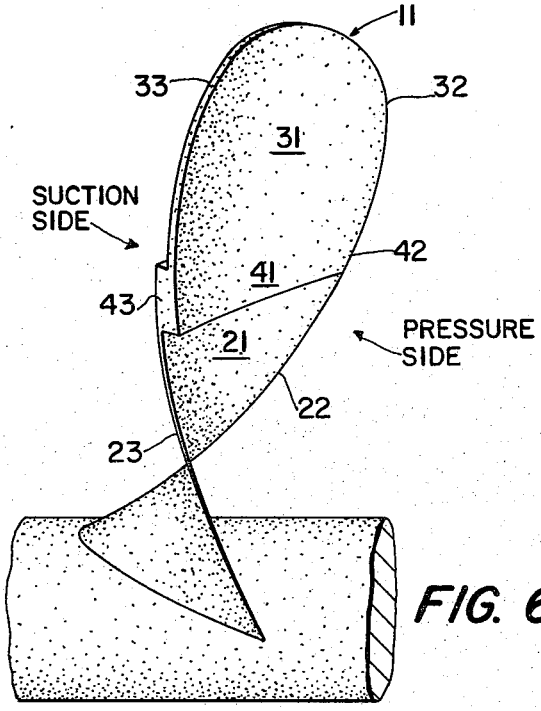
FIG. 6

TRANSCAVITATING PROPELLER

BACKGROUND OF THE INVENTION

The present invention relates to a marine propeller and, more particularly, to a propeller design which is capable of efficient adaptation for a wide range of propeller speeds and cavitation conditions.

The operation of propellers is based upon principles which have been generally accepted for many years, wherein, for example, effective performance depends upon maintaining an optimum pressure differential between the opposite surfaces of the propeller blades. However, application of basic propeller principles to actual operating and design conditions involves the interplay of numerous variables such as the blade speed, the multidirectional fluid flow, the vapor pressure of the surrounding fluid, induction of air into the fluid, the configuration of the surfaces of the propeller blades, and cavitation on and adjacent to the surfaces of the propeller blades. Thus, design of an efficient marine propeller, which would seem at first glance to be rather simple, actually involves many complex factors and requires much trial and error. Also, slight changes and modifications of a proposed design may have great and unobvious effects on the operating characteristics and efficiency of the propeller.

Cavitation represents an important consideration with respect to efficient operation of the propeller, reduces noise propagation and improved blade wear. Cavitation results from a local reduction in fluid pressure to a value lower than or equal to the vapor pressure of water. A cavitating flow is naturally produced in a liquid when the relative speed between an immersed body and the liquid is great enough to induce sufficiently low fluid pressures so that the liquid is caused to vaporize and produce a cavity. A cavitating flow may also be produced through the artificial introduction of a gas, such as air, into a liquid in the vicinity of the immersed body so that a cavity is more easily formed thereabout. Each cavity usually contains a swirling mass of droplets and vapor which suddenly collapse when the surrounding fluid pressure becomes high enough and the collapsing fluid, which rushes to fill the void, momentarily raises the localized fluid pressure to a high peak value. If the point of collapse is in contact with a propeller blade, the surface of the blade receives a blow which may erode such surface; cause a large amount of vibration and noise; and reduce the thrust efficiency of the propeller.

Cavitation on the propeller blade can be avoided by limiting the propeller speed and using larger propeller blades. However, this solution soon reaches practical limits inasmuch as the bearings, gears and power train elements soon take up a large amount of space that could be used for other purposes. Another means of avoiding cavitation damage on the surface of a propeller blade is by utilizing a supercavitating blade which causes a cavity of sufficient length so that it extends downstream of the blade and has its point of collapse also downstream of the blade. However, supercavitating propeller blades are not very efficient at low speed, noncavitating conditions since the pressure distribution and the lift to drag ratios of the propeller blade are distinctly different than those parameters for high speed cavitating conditions. At such noncavitating or subcavitating conditions propeller blades are commonly used which have rounded leading edges and tapered trailing edges, as distinguished from supercavitating blades which normally have tapered leading edges and blunt trailing edges.

For particular applications such as with planing type boats, which employ high speed propellers positioned close to the water surface, or medium speed hydrofoils where both subcavitating and supercavitating conditions occur adjacent the propeller blades, there has not been generally available a propeller blade design which is capable of efficient operation, reduced noise generation and improved wearability. In intermediate flow states with co-existing supercavitating and subcavitating flow conditions, subcavitating propellers tend to induce oscillating cavitation cavities and supercavitating propellers are highly inefficient.

SUMMARY OF THE INVENTION

Accordingly, the propeller of the present invention overcomes problems experienced with the prior art by providing propeller blades capable of efficient operation at intermediate speed ranges and under varying cavitation conditions. This is generally accomplished by forming the radially outer portion of the blade with a different blade shape than the radially inner portion wherein a transition zone is formed therebetween so that the outer blade portion has a higher blade angle of attack than the inner blade portion. Preferably, the inner blade portion is provided with a rounded leading edge and a tapered trailing edge with arcuate pressure and suction surfaces extending therebetween. The outer blade portion is provided with a tapered leading edge and a blunt trailing edge so that a cavitation cavity formed as a result of a high blade speed, for example, will extend downstream of the blunt trailing edge. Generally the transition zone, which is thicker than the adjacent inner and outer blade portions, tapers in thickness from the trailing edge to the leading edge of the blade so that inner and outer shoulders are respectively formed on the pressure and suction surfaces of the blade. Thus, the pressure side of the transition zone includes a transition pressure surface, which is generally coextensive with the pressure surface of the outer blade portion, and a transverse pressure surface, which extends between the transition pressure surface and the pressure surface of the inner blade portion. Similarly, the suction side of the transition zone includes a suction surface which is generally coextensive with the suction surface of the inner blade portion and a transverse suction surface which extends between the transition suction surface and the suction surface of the outer blade portion. The shoulders defined by the intersection of the respective transition surfaces and transverse surfaces provide a means for reinforcing the inner and outer blade portions at the transition zone. The shoulders also provide a means for stabilizing supercavitating flow conditions at the outer blade portion and for producing subcavitating flow conditions at the inner blade portion.

It is thus an object of this invention to provide a marine propeller for efficient operation in coexisting supercavitating and subcavitating flow conditions.

Another object of the invention is to provide a means for reducing propeller noise and the deleterious effect of propeller cavitation without sacrificing propeller speed and thrust efficiency.

A further object of this invention is to provide a marine propeller wherein the radially outer blade portion is of the supercavitating type and wherein the radially inner blade portion is of the subcavitating type with a transition zone extending therebetween for providing flow and propeller stability.

BRIEF DESCRIPTION OF THE DRAWINGS

The novel features characteristic of this invention are set forth with particularity in the appended claims. The invention itself, however, both as to its organization and method of operation, together with further objects and advantages thereof, may be best understood by reference to the following description taken in connection with the accompanying drawings, in which:

FIG. 1 is a view of the suction side of a propeller blade;

FIG. 2 is a view of the pressure side of a propeller blade;

FIG. 3 is a sectional view of FIG. 2 taken along line 3—3 of FIG. 2;

FIG. 4 is a sectional view of FIG. 2 taken along line 4—4 of FIG. 2;

FIG. 5 is a sectional view of FIG. 1 taken along line 5—5 of FIG. 1; and FIG. 6 is a perspective view of a propeller blade.

DETAILED DESCRIPTION OF THE DRAWINGS

Referring now to the drawings there is generally shown in FIG. 1 a view of the suction side of a propeller blade 11 having a leading edge and a trailing edge, wherein such blade includes a radially inner blade portion 21, a radially outer blade portion 31, and an intermediate transition zone 41 extending therebetween. Similarly, FIG. 2 is a view of the pressure side of a propeller blade having leading and trailing edges and including radially inner portion 21, radially outer portion 31 and intermediate transistion portion 41. Although only one propeller blade is depicted in the drawings, a propeller formed of such blades will normally have a plurality of blades.

Generally, the radially inner portion 21 of the propeller blade 11 is of the cross-sectional shape shown in FIG. 3 with an arcuate, convex suction surface 24 and a concave pressure surface 25. The radially inner blace portion 21, which decreases in thickness from the rounded leading edge 22 to the tapered trailing edge 23, has a profile similar to conventional noncavitating propeller blades that provide a high lift-to-drag ratio, high efficiency, and low susceptibility to flow variations. Such flow variations include boundary layer separation between the propeller blade and the fluid and also cavitation on suction surface 24 of inner blade portion 21.

The radially outer portion 31 of propeller blade 11 has a cross-section of the type shown in FIG. 4, wherein the blade thickness increases from the sharply tapered leading edge 32 to the blunt trailing edge portion 33. This type of blade profile, which is not as efficient as conventional propeller blades in noncavitating operation conditions, is especially suitable for supercavitating conditions wherein the suction surface 34 is contained within a cavitation envelope and the pressure surface 35 is wetted to minimize erosion and vibration of the blade. Supercavitating blade designs were derived from recognition that a thin hydrofoil or blade section having a predetermined camber and angle of attack and which is moving through the water at great enough speed to cause cavitation in the water, will produce a cavity on suction surface 34 of the blade, which is reasonably thin at leading edge 32 and which increases in thickness to a point beyond trailing edge 33 of the blade where the fluid pressure becomes too great to sustain the cavity. The extent of the cavity can be increased, for example, by increasing the blade angle of the attack and/or the propeller blade speed.

The blade transition zone 41 shown in FIGS. 1, 2, 5 and 6 which tapers in thickness from the trailing edge portion 43 to the leading edge portion 42 of the blade, is thicker than adjacent regions of the inner and outer blade portions 21, 31 so that shoulders 47, 57 are respectively formed on the suction and pressure sides of the blade. Thus, the pressure side of transition zone 41 includes a transition pressure surface 55 which is generally coextensive with pressure surface 35 of outer blade portion 31 and also a transverse pressure surface 56 which extends between transition pressure surface 55 and pressure surface 25 of inner blade portion 21. The transition pressure surface 55 and transverse pressure surface 56 intersect to define a pressure shoulder 57. Similarly, the suction side of the transition zone 41 includes a transition suction surface 44, which is generally coextensive with suction surface 24 of inner blade portion 21, and a transverse suction surface 46, which extends from suction surface 34 of outer blade portion 31 and intersects transition suction surface 44 to define a suction shoulder 47. The shoulders 47, 57 form a means for improving the flow of fluid across the propeller blades. For example, the shoulders 47 and 57 help to stabilize the location of cavitation cavities formed about the blade 11 wherein, for example, small intermittent changes in the blade speed tend to cause erratic movement of the cavitation cavity.

It is additionally seen from the drawings that while the leading edge 42 of transition zone 41 is colinear with the adjacent leading edges 22, 32, of inner and outer blade portions 21, 31, the trailing edges 23, 33 of inner and outer blade portions 21, 31 are offset from each other at transition zone 41 so that outer blade portion 31 has a higher blade angle of attack than inner blade portion 21. Because outer blade portion 31 has a higher blade angle of attack than inner blade portion 21; a supercavitating profile; and a higher blade speed due to increased radial distance from the propeller axis; the outer blade portion 31 has a greater tendency to promote supercavatating flow thereabout. Thus, under flow conditions where an unstable cavity may form about portions of a propeller blade, such as for example with planing type of boats where ventilation of air may occur adjacent to the propeller blades, the propeller blade of the present invention may be utilized to stabilize the cavity and minimize propeller noise and blade erosion.

While the radial location of transition zone 41 will vary according to the design parameters for a particular blade, the transition zone 41 will preferably be located from about 20% to about 80% of the radial distance from the base 12 to the tip 13 of blade 11. For example, if transition zone 41 is located close to or at the base or hub portion of the propeller blade 11, the shoulder portions 47, 57 and the change in blade profile at transition zone 41 may cause an irregular fluid wake or perhaps base cavitation of the blade 11, which interfers with the efficiency of the other propeller blades. Also, with the transition zone 41 is formed close to the tip 13 of the propeller blade 11, the outer surface region of the blade becomes greatly reduced so that the advantages of supercavitating flow on such blade and the stabilization of cavitation cavities are accordingly reduced.

To provide reinforcement necessary to accomodate changes in the blade stress patterns between the inner and outer blade portions 21, 31, the radial length of the transition zone 41, as measured at the trailing edge 43, will preferably be from about 2 to about 4 times the blade thickness of the transition zone 41. Also, while the dimensions of the transition zone 41 will vary from blade to blade, the shoulders 47, 57 are preferably formed with sharp edges to promote a sharp transition in the fluid wake and the interior corners 48, 58 of the transition zone 41 should be rounded to minimize stress concentrations in the blade 11. While the blade stress discontinuities in the transition zone 41 will increase with an increase in the blade angle of attack, an offset angle 14, as shown in FIGS. 1 and 3, of from about 2° to about 10° generally will not cause adverse stress discontinuities in the blade 11.

Obviously many modifications and variations of the present invention are possible in light of the above teachings. It is therefore to be understood that within the scope of the appended claims the invention may be practiced otherwise than as specifically described.

What is claimed is:

1. A propeller blade for attachment to a central propeller hub comprises:

a radial inner blade portion, wherein said inner blade portion includes a rounded leading edge portion and a tapered trailing edge portion with arcuate pressure and suction surfaces extending therebetween;

a radial outer blade portion, wherein said outer blade portion includes a tapered leading edge portion and a blunt trailing edge portion with arcuate pressure and suction surfaces extending therebetween; and a transition portion blade portion extending between said inner and outer blade portions, wherein said transition blade portion includes a leading edge portion and a trailing edge portion, said transition blade portion generally increases in thickness from said leading edge portion to said trailing portion, said leading edge portions of said inner, outer and transition blade portions are substantially colinear with each other, and said trailing edge portions of said inner and outer blade portions are offset from each other.

2. The propeller according to claim 1, wherein said blade includes a base portion for connection to the hub and a radially distal tip portion spaced therefrom; and said transition blade portion is located from said base portion at about 20 percent to about 80 percent of the radial distance between said base and said tip portions.

3. The propeller according to claim 1, wherein:

the radial length of said trailing edge portion of said transition blade portion is from about one to about five times the thickness of said trailing edge portion of said transition blade portion.

4. The propeller according to claim 1, wherein:

said inner and outer blade portions generally define intersecting planes which are pivotally offset from each other at an angle of from about 1 degree to about 20 degrees.

5. The propeller according to claim 1, wherein:

said transition blade portion includes pressure and suction blade surfaces extending between said leading and trailing edge portions with shoulder means formed thereon for stabilizing the location of cavitation cavities formed about said inner, outer and transition blade portions.

6. The propeller according to claim 5, wherein:

each of said shoulder means comprises a shoulder formed by intersecting blade surfaces which extend generally normal to each other.

7. The propeller according to claim 1, wherein:

said transition blade portion includes a suction surface which is substantially coextensive with the adjacent region of said inner blade portion suction surface, and a transverse suction surface which extends between said transition suction surface and said outer blade portion suction surface, wherein a shoulder is formed by the intersection of said transition suction surface and said transverse suction surface.

8. The propeller according to claim 7 wherein:

said transition blade portion includes a pressure surface which is substantially coextensived with the adjacent region of said outer blade portion pressure surface, and a transverse pressure surface which extends between said transition pressure surface and said inner blade portion pressure surface wherein a shoulder is formed by the intersection of said transition pressure surface and said transverse pressure surface.

9. The propeller according to claim 8, wherein:

said transition suction surface lies in a plane which forms an angle of between about two to about twelve degrees with an intersecting plane generally defined by the adjacent region of said outer blade portion suction surface, and said transition pressure surface lies in a plane which forms an angle of between about two to about twelve degrees with an intersecting plane generally defined by the adjacent region of said inner blade portion pressure surface.

10. A propeller blade designed for attachment to a propeller hub and comprising:

a radial inner blade portion, said inner blade portion includes a rounded leading edge portion and a tapered trailing edge portion with arcuate pressure and suction surfaces extending therebetween;

a radial outer blade portion, said outer blade portion includes a tapered leading edge portion and a blunt trailing edge portion with arcuate pressure and suction surfaces extending therebetween;

a transition blade portion extending between said inner and outer blade portions, wherein said transition blade portion includes a leading edge portion and a trailing edge portion, said leading edge portions of said inner, outer and transition blade portions are sutstantially colinear with each other, said trailing edge portions of said inner and outer blade portions are offset from each other, and the radial length of said trailing edge portion of said transition blade portion is between about two to about four times the thickness of said trailing edge portion of said transition blade portion;

a blade base portion formed on said inner blade portion at one end of the blade; and a blade tip portion formed on said radially outer blade portion at the other end of the blade wherein said transition blade portion is located between about twenty to about eighty percent of the distance from said base to said tip, and adjacent regions of said suction surfaces of said inner and outer blade portions lie in planes which intersect to form a pivotal angle therebetween of from about two degrees to about twenty degrees.

11. A propeller blade for attachment to a central propeller hub comprises:

a radial inner blade portion having a rounded leading edge portion and a tapered trailing edge portion;

a radial outer blade portion having a tapered leading edge portion and a blunt trailing edge portion; and a transition blade portion extending between said inner and outer blade portions, wherein said transition blade portion includes a leading edge portion and a trailing edge portion, said leading edge portions of said inner, outer and transition blade portions are substantially colinear with each other, and said trailing edge portion of said inner and outer blade portions are offset from each other.

12. A propeller blade for attachment to a central propeller hub comprises:

a radial inner blade portion having a rounded leading edge portion and a tapered trailing edge portion; and a radial outer blade portion having a tapered leading edge portion and a blunt trailing edge portion.

13. A propeller blade for attachment to a central propeller hub comprises:

a radial inner blade portion having a rounded leading edge portion and a tapered trailing edge portion;

a radial outer blade portion having a tapered leading edge portion and a blunt trailing edge portion; and a transition blade portion extending between said inner and outer blade portions, wherein said transition blade portion includes a leading edge portion and a trailing edge portion and said transition blade portion generally increases in thickness from said leading edge portion to said trailing edge portion.

* * * * *